US011306739B2

(12) United States Patent
Hong et al.

(10) Patent No.: US 11,306,739 B2
(45) Date of Patent: Apr. 19, 2022

(54) FAN DEVICE

(71) Applicants: INVENTEC (PUDONG) TECHNOLOGY CORPORATION, Shanghai (CN); INVENTEC CORPORATION, Taipei (TW)

(72) Inventors: Shi-Min Hong, Shanghai (CN); Hai Ting Chen, Shanghai (CN); Chao Nie, Shanghai (CN)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 366 days.

(21) Appl. No.: 16/660,688

(22) Filed: Oct. 22, 2019

(65) Prior Publication Data

US 2021/0062828 A1 Mar. 4, 2021

(30) Foreign Application Priority Data

Sep. 3, 2019 (CN) ..... 201910827540.X

(51) Int. Cl.
*F04D 29/64* (2006.01)
*F04D 29/40* (2006.01)

(52) U.S. Cl.
CPC ..... *F04D 29/646* (2013.01); *F04D 29/40* (2013.01); *F05B 2230/606* (2013.01); *F05B 2230/61* (2013.01); *F05D 2230/642* (2013.01); *F05D 2230/68* (2013.01)

(58) Field of Classification Search
CPC ..... F04D 29/646; F05D 2230/642; F05D 2230/68; H02K 5/22; H02K 2250/00; H05K 7/20172
See application file for complete search history.

(56) References Cited

U.S. PATENT DOCUMENTS

| | | | | |
|---|---|---|---|---|
| 6,040,981 A * | 3/2000 | Schmitt | G06F 1/18 | 312/221 |
| 7,215,556 B2 * | 5/2007 | Wrycraft | H05K 7/1409 | 361/741 |
| 7,558,061 B2 * | 7/2009 | Franz | F04D 29/646 | 361/695 |
| 9,370,118 B2 * | 6/2016 | Li | H05K 7/1409 | |
| 2013/0058781 A1 * | 3/2013 | Fu | H05K 7/20727 | 415/220 |

* cited by examiner

*Primary Examiner* — Eldon T Brockman
*Assistant Examiner* — Brian O Peters
(74) *Attorney, Agent, or Firm* — Maschoff Brennan

(57) ABSTRACT

A fan device configured to be assembled to chassis having engagement slot and including casing, fan, clip, handle, and trigger. Casing includes bottom plate, front plate and top plate. Top plate at least partially covers bottom plate and has through hole. Opposite sides of front plate are respectively connected to bottom plate and front plate. Fan is disposed on casing. Clip includes elastic part, engagement part and pressed part. Elastic part has fixed side and movable side that are opposite. Fixed side is disposed on top plate. Movable side is located closer to top plate than fixed side. Engagement part is connected to movable side. Engagement part is disposed through the through hole to be engaged with engagement slot. Pressed part is connected to movable side. Handle is disposed on front plate. Trigger is movably disposed on handle.

10 Claims, 5 Drawing Sheets

FAN DEVICE

CROSS-REFERENCE TO RELATED APPLICATIONS

This non-provisional application claims priority under 35 U.S.C. § 119(a) on Patent Application No(s). 201910827540.X filed in China, on Sep. 3, 2019, the entire contents of which are hereby incorporated by reference.

BACKGROUND OF THE INVENTION

Technical Field of the Invention

The disclosure relates to a fan device, more particularly to a fan device that can be assembled to a casing without using screws.

Description of the Related Art

During the operation of the electronic device such as personal computer or server, a large amount of the heat is generated. The amount of such heat is related to the operation duration and the performance of the electronic device. When such heat is accumulated in the electronic device, the inner temperature of the electronic device is increased, which affects the performance of the electronic device or even causes the electronic device to shut down. Therefore, a heat dissipation device, such as a fan, is generally disposed in the electronic device for dissipating the heat generated during the operation of the electronic device.

SUMMARY OF THE INVENTION

One aspect of this disclosure provides a fan device configured to be assembled to a chassis having an engagement slot and including a casing, a fan, a clip, a handle, and a trigger. The casing includes a bottom plate, a front plate and a top plate. The top plate at least partially covers the bottom plate and has a through hole. Opposite sides of the front plate are respectively connected to the bottom plate and the front plate. The fan is disposed on the casing. The clip includes an elastic part, an engagement part and a pressed part. The elastic part has a fixed side and a movable side that are opposite to each other. The fixed side of the elastic part is disposed on the top plate. The movable side is located closer to the top plate than the fixed side. The engagement part is connected to the movable side of the elastic part. The engagement part is disposed through the through hole of the top plate to be engaged with the engagement slot of the chassis. The pressed part is connected to the movable side of the elastic part. The handle is disposed on the front plate. The trigger is movably disposed on the handle. When the pressed part of the clip is pushed by the trigger, the trigger moves the movable side of the elastic part away from the top plate so as to move the engagement part out of the engagement slot.

BRIEF DESCRIPTION OF THE DRAWINGS

The present invention will become more fully understood from the detailed description given hereinbelow and the accompanying drawings which are given by way of illustration only and thus are not limitative of the present invention and wherein.

DETAILED DESCRIPTION

Figure 1:
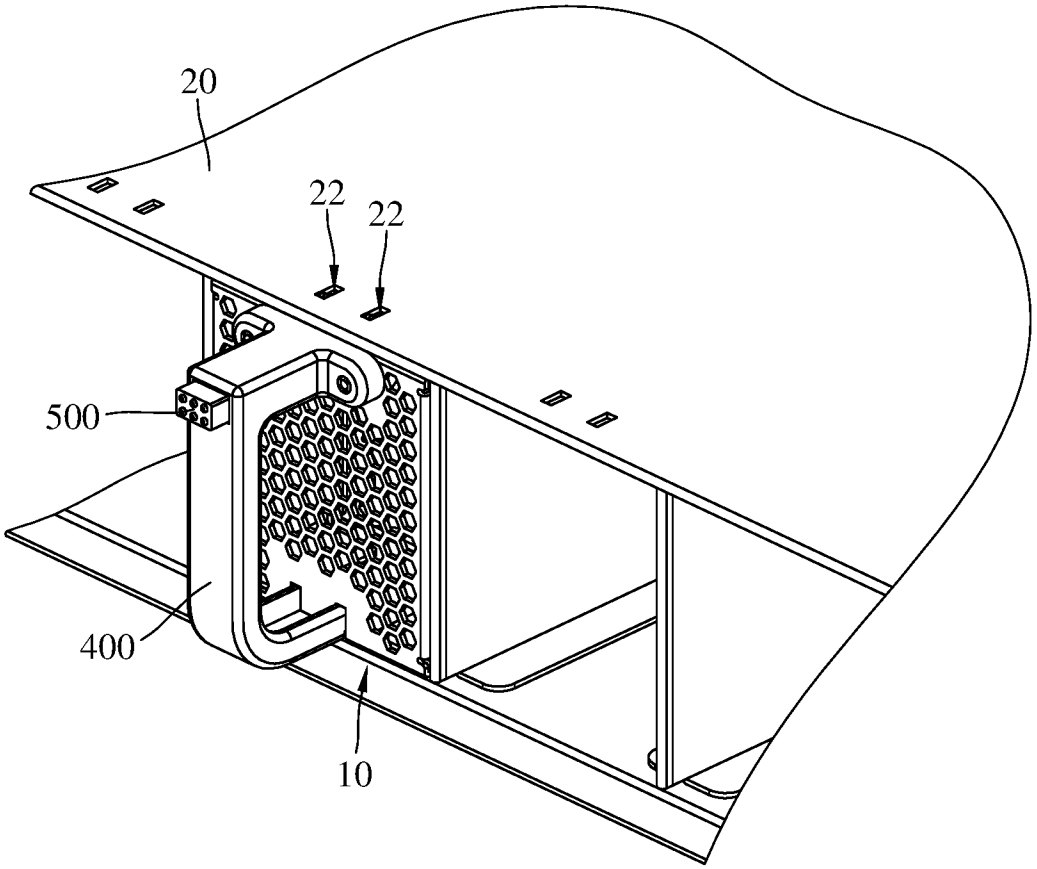
FIG. 1 is a perspective view of a fan device according to a first embodiment of the invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
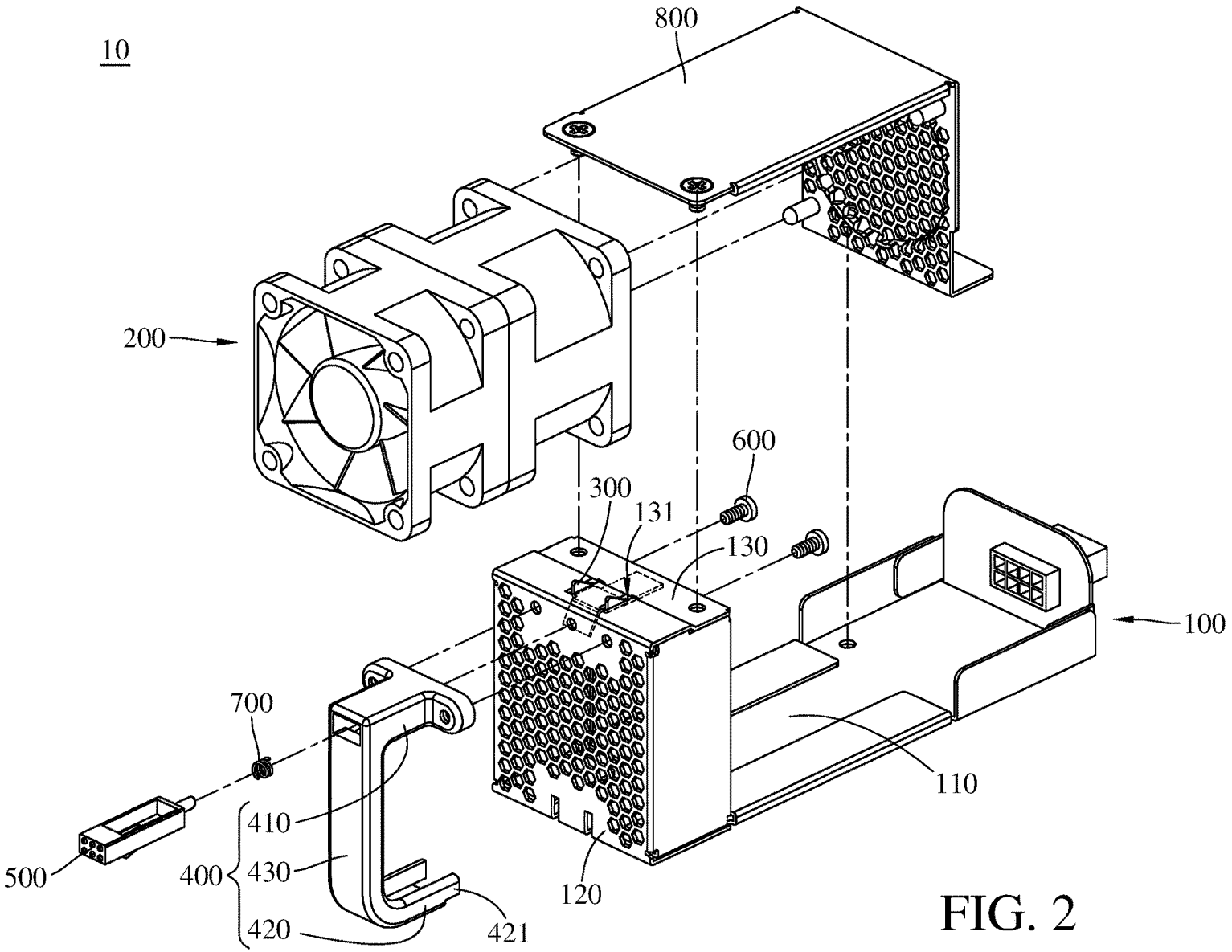
FIG. 2 is an exploded view of the fan device in FIG. 1.
Figure 3:
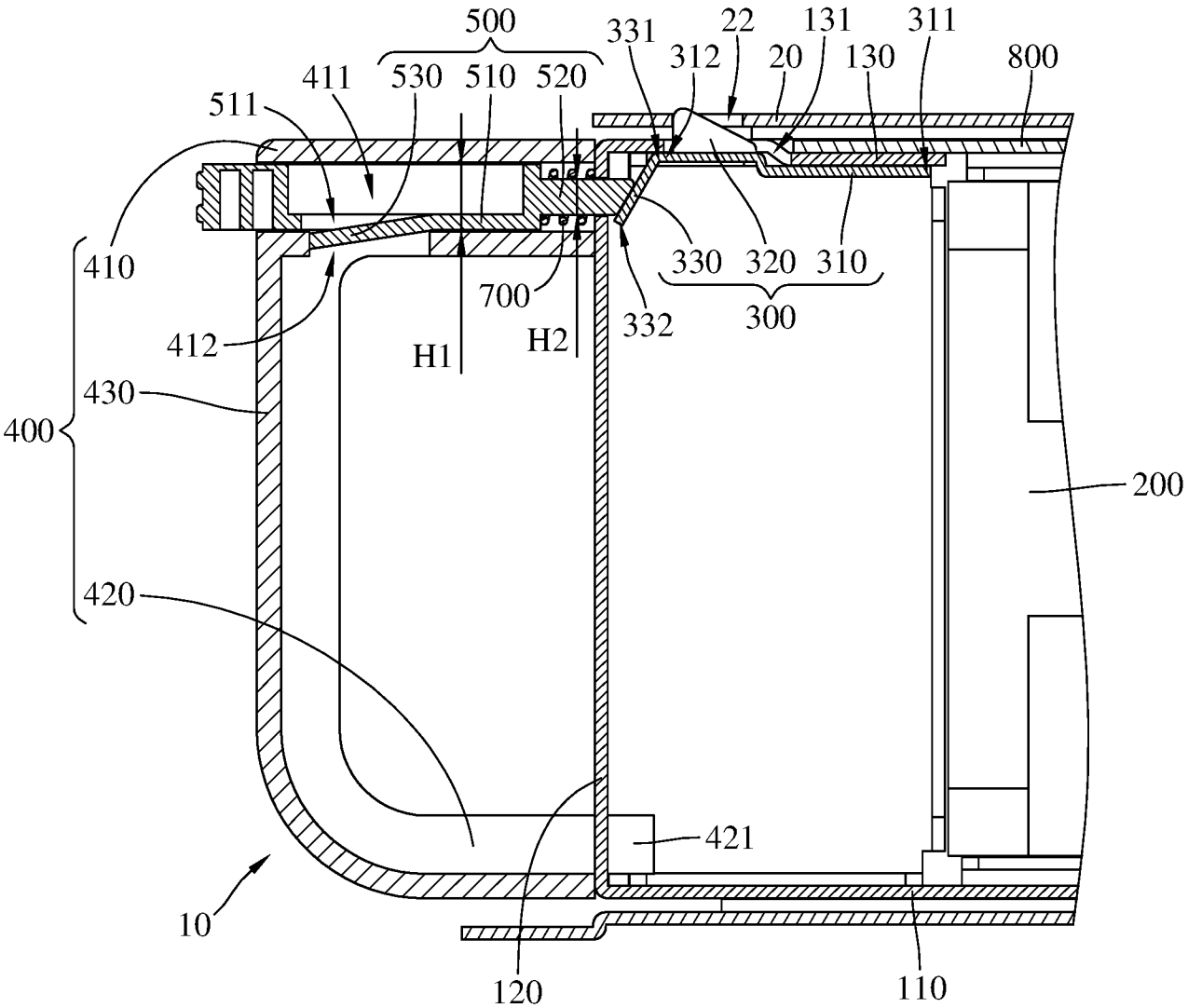
FIG. 3 is a cross-sectional view of the fan device in FIG. 1.

Please refer to FIG. 1 to FIG. 3, where FIG. 1 is a perspective view of a fan device according to a first embodiment of the invention, FIG. 2 is an exploded view of the fan device in FIG. 1, and FIG. 3 is a cross-sectional view of the fan device in FIG. 1.

This embodiment provides a fan device 10 configured to be mounted on a chassis 20 that has an engagement slot 22. The fan device 10 includes a casing 100, a fan 200, a clip 300, a handle 400, a trigger 500, a fastener 600, an elastic component 700 and a shield 800.

The casing 100 includes a bottom plate 110, a front plate 120 and a top plate 130. Two opposite sides of the front plate 120 are respectively connected to the bottom plate 110 and the front plate 120. The top plate 130 has a through hole 131, at least part of the bottom plate 110 is covered by the top plate 130.

The fan 200 is disposed on the casing 100, and is, for example, an axial fan.

The clip 300 includes an elastic part 310, an engagement part 320 and a pressed part 330. The elastic part 310 has a fixed side 311 and a movable side 312 that are opposite to each other. The fixed side 311 of the elastic part 310 is, for example, riveted to the top plate 130. Due to the elasticity of the elastic part 310, the movable side 312 can be moved relative to the fixed side 311. In addition, the movable side 312 is located closer to the top plate 130 than the fixed side 311. The engagement part 320 is connected to the movable side 312 of the elastic part 310. The engagement part 320 is disposed through the through hole 131 of the top plate 130 and engaged with the engagement slot 22 of the chassis 20. The pressed part 330 is connected to the movable side 312 of the elastic part 310. In detail, the pressed part 330 has a first side 331 and a second side 332 that are opposite to each other, the first side 331 of the pressed part 330 is connected to the movable side 312 of the elastic part 310, and the second side 332 is located closer to the bottom plate 110 and the front plate 120 than the first side 331, so that the pressed part 330 is inclined.

The handle 400 is disposed on the front plate 120. In concrete, the handle 400 includes a first mount portion 410, a second mount portion 420 and a gripping portion 430. The first mount portion 410 has a slide groove 411 and a block groove 412 that is connected to the slide groove 411. The first mount portion 410 and the second mount portion 420 are disposed on the front plate 120 respectively via, for example, the fastener 600 and an engagement structure 421. In addition, the first mount portion 410 is located closer to the top plate 130 than the second mount portion 420. The gripping portion 430 connects the first mount portion 410 and the second mount portion 420, and is spaced apart from the front plate 120.

The trigger 500 includes a pressed part 510 and a pressing part 520 that are connected to each other. The pressed part 510 is slidably disposed in the slide groove 411 of the first mount portion 410. Part of the pressed part 510 protrudes from a side of the first mount portion 410 that is located away from the front plate 120, thereby allowing the pressed part 510 to be pressed. The pressed part 510 can be slid relative to the first mount portion 410 so as to force the pressing part 520 to press against or be moved away from a side of the pressed part 330 of the clip 300 that is located away from the elastic part 310. When the pressing part 520 presses against the side of the pressed part 330 of the clip 300 that is located away from the elastic part 310, the movable side 312 of the elastic part 310 is moved away from the top plate 130.

In this embodiment, a height H2 of the pressing part 520 is smaller than a height H1 of the pressed part 510. The elastic component 700 is sleeved on the pressing part 520, and is, for example, a compression spring which can be compressed by the pressed part 510 and the front plate 120. The elastic component 700 is sandwiched between the pressed part 510 and the front plate 120 so that the trigger 500 can be restored to its original position via the restoring force exerted by the elastic component 700. However, the elastic component 700 is not limited to be a compression spring. In other embodiments, the elastic component 700 may be an extension spring or other suitable type of spring, as long as such type of spring can restore the trigger 500 to its original position.

In this embodiment, the pressed part 510 has a space 511 that may be a recess or an opening, and the trigger 500 further includes a block clip 530. The block clip 530 is, for example, integrally formed with the pressed part 510. A side of the block clip 530 is connected to a surface (not labeled) of the pressed part 510 forming the space 511. Another side of the block clip 530 extends toward the bottom plate 110, so that when the trigger 500 is moved away from the front plate 120, the block clip 530 is engaged with the block groove 412 of the first mount portion 410, thereby preventing the trigger 500 from sliding out of the first mount portion 410.

In this embodiment, the block clip 530 and the pressed part 510 are integrally formed, but the invention is not limited thereto. In other embodiments, the block clip 530 and the pressed part 510 may not be integrally formed and may be fixed to each other by a lock or may be adhered to each other.

A side of the shield 800 is disposed on the bottom plate 110 of the casing 100, another side of the shield 800 is disposed on the top plate 130 of the casing 100, and the fan 200 is surrounded by the casing 100 and the shield 800.

Figure 4:
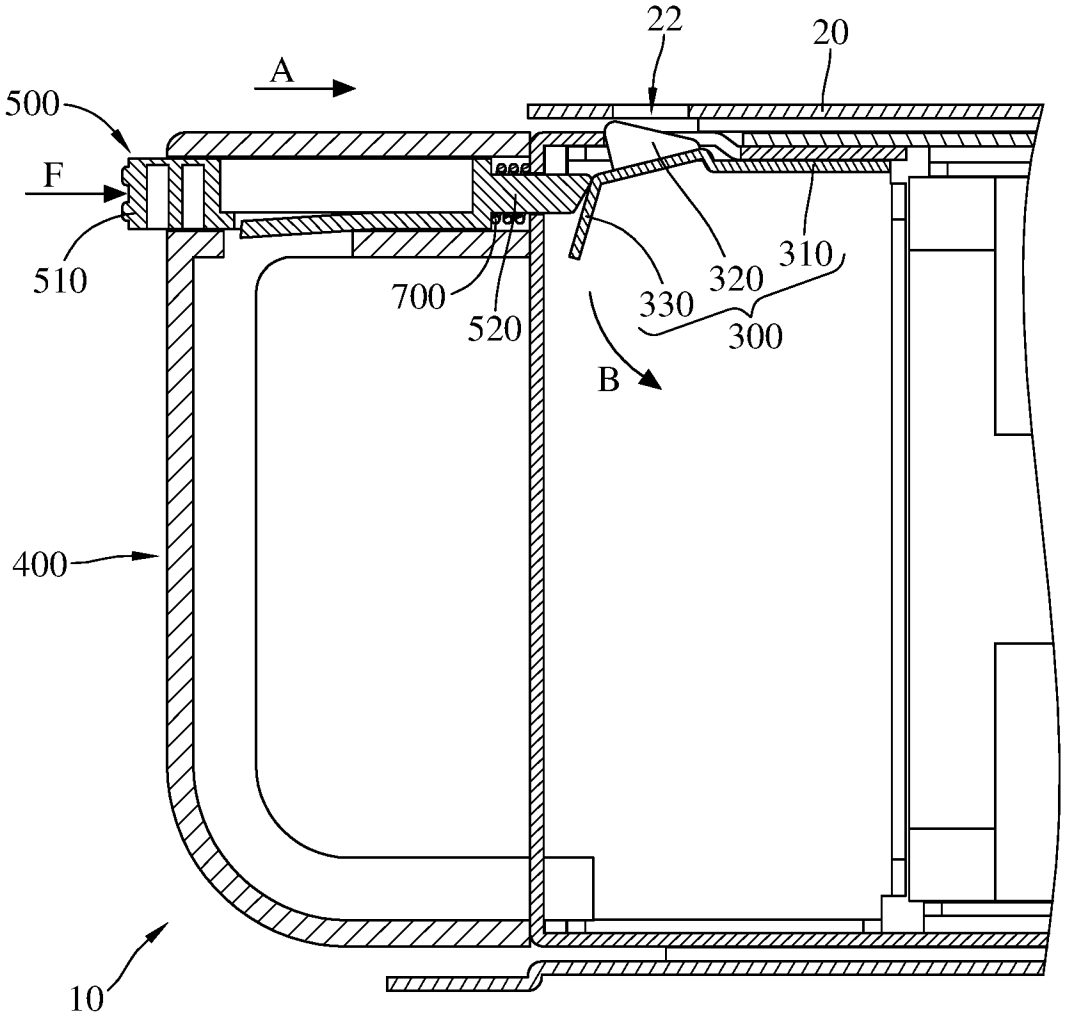
FIG. 4 and FIG. 5 are schematic view showing the operation for the fan device in FIG. 1 to be detached from a casing.
Figure 5:
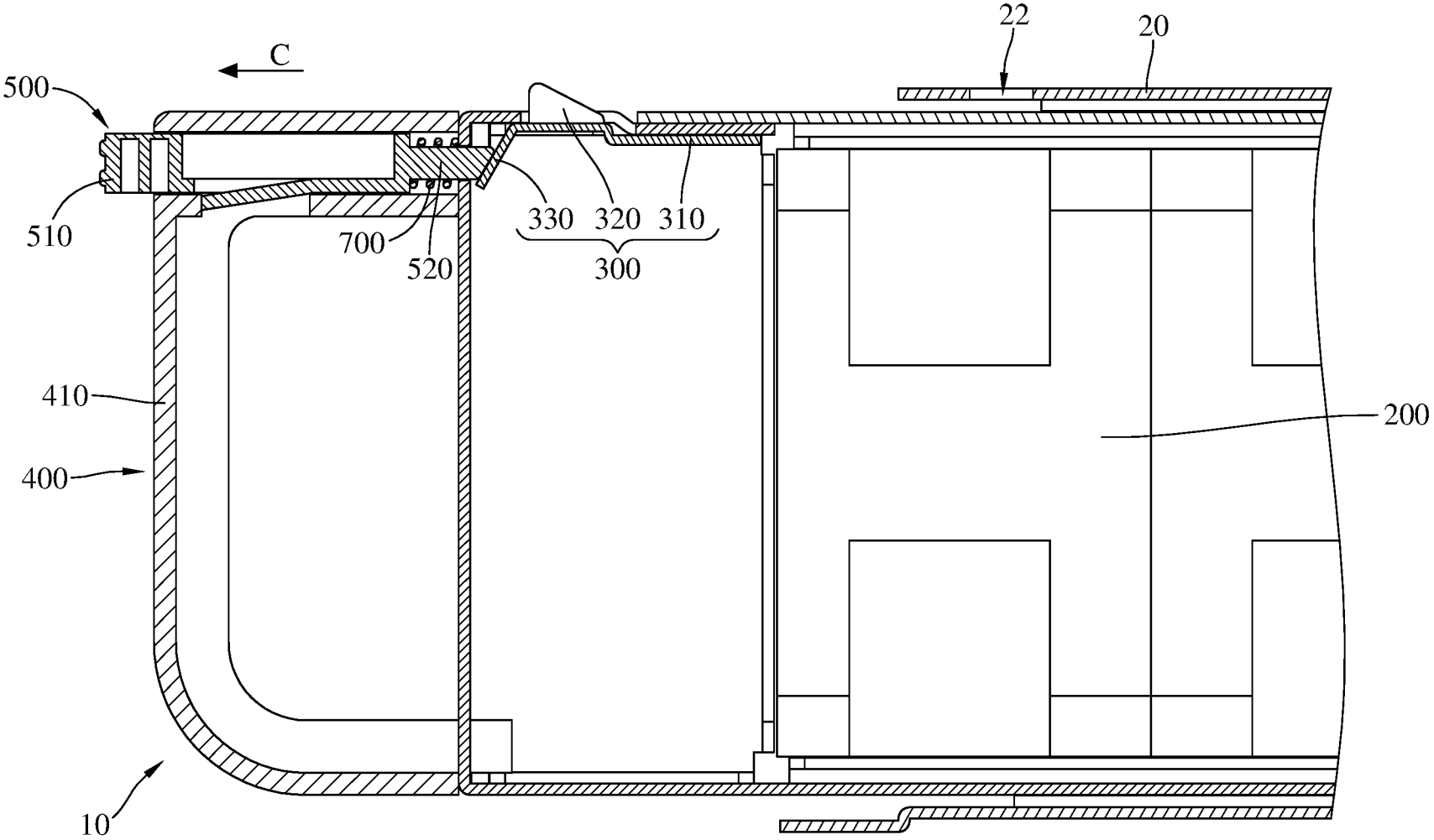

Please refer to FIG. 3 to FIG. 5, where FIG. 4 and FIG. 5 are schematic view showing the operation for the fan device in FIG. 1 to be detached from a casing.

As shown in FIG. 3, when the fan device 10 is pushed into the chassis 20, the engagement part 320 of the clip 300 is engaged with the engagement slot 22 of the chassis 20 due to the elasticity of the elastic part 310, thereby assembling the fan device 10 and the chassis 20.

Next, as shown in FIG. 4, when the trigger 500 is pressed by a force F exerted by, for example, a single finger of the user, the trigger 500 is moved along a direction A so as to force the pressing part 520 to push the pressed part 330, and thus moving the pressed part 330 along a direction B. When the pressed part 330 is moved along the direction B, the engagement part 320 disposed on the elastic part 310 is moved downwards and thus moved away from the engagement slot 22 of the chassis 20. Accordingly, the fan device 10 can be disengaged from the chassis 20 merely by pressing the trigger 500 with single finger, such that it is favorable for a convenient disengagement of the fan device 10 from the chassis 20. As shown in FIG. 5, after the engagement part 320 is disengaged from the chassis 20, the fan device 10 can be removed from the chassis 20 by being moved along a direction C.

According to the fan device discussed above, since the clip can be pushed by the trigger, the fan device can be disengaged from the chassis merely by pressing the trigger with single finger, such that the convenience for disengaging the fan device 10 from the chassis 20 is improved.

It will be apparent to those skilled in the art that various modifications and variations can be made to the present invention. It is intended that the specification and examples be considered as exemplary embodiments only, with a scope of the invention being indicated by the following claims and their equivalents.

What is claimed is:

1. A fan device, configured to be assembled to a chassis having an engagement slot, the fan device comprising:

a casing, comprising a bottom plate, a front plate and a top plate, wherein the top plate at least partially covers the bottom plate and has a through hole, and opposite sides of the front plate are respectively connected to the bottom plate and the front plate;

a fan, disposed on the casing;

a clip, comprising an elastic part, an engagement part and a pressed part, wherein the elastic part has a fixed side and a movable side that are opposite to each other, the fixed side of the elastic part is disposed on the top plate, the movable side is located closer to the top plate than the fixed side, the engagement part is connected to the movable side of the elastic part, the engagement part is disposed through the through hole of the top plate to be engaged with the engagement slot of the chassis, and the pressed part is connected to the movable side of the elastic part;

a handle, disposed on the front plate; and a trigger, movably disposed on the handle, wherein when the pressed part of the clip is pushed by the trigger, the trigger moves the movable side of the elastic part away from the top plate so as to move the engagement part out of the engagement slot.

2. The fan device according to claim 1, wherein the pressed part has a first side and a second side that are opposite to each other, the first side of the pressed part is connected to the movable side of the elastic part, and the second side is located closer to the bottom plate and the front plate than the first side.

3. The fan device according to claim 2, wherein the handle comprises a first mount portion, a second mount portion and a gripping portion, the first mount portion and the second mount portion are disposed on the front plate, the first mount portion is located closer to the top plate than the second mount portion, the gripping portion is connected to the first mount portion and the second mount portion, the gripping portion is spaced apart from the front plate, and the trigger is movably disposed on the first mount portion.

4. The fan device according to claim 3, further comprising a fastener, wherein the first mount portion is mounted on the front plate via the fastener, and the second mount portion is mounted on the front plate via an engagement structure.

5. The fan device according to claim 3, wherein the trigger comprises a pressed part and a pressing part that are connected, a part of the pressed part protrudes from a side of the first mount portion that is located away from the front plate, and the pressing part presses against a side of the pressed part that is located away from the elastic part.

6. The fan device according to claim 5, further comprising an elastic component, wherein a height of the pressing part is smaller than a height of the pressed part, the elastic component is sleeved on the pressing part, and the elastic component is sandwiched between the pressed part and the front plate.

7. The fan device according to claim 6, wherein the elastic component is a compression spring.

8. The fan device according to claim 5, wherein the pressed part has a space, the first mount portion has a slide groove and a block groove that is connected to the slide groove, the trigger further comprises a block clip, one side of the block clip is connected to a surface of the pressed part forming the space, another side of the block clip extends toward the bottom plate, and the block clip is configured to be engaged with the block groove of the first mount portion, thereby preventing the trigger from sliding out of the first mount portion.

9. The fan device according to claim 5, wherein the block clip and the pressed part are integrally formed.

10. The fan device according to claim 1, further comprising a shield, wherein a side of the shield is assembled to the bottom plate of the casing, another side of the shield is assembled to the top plate of the casing, and the fan is surrounded by the casing and the shield.

* * * * *